US005984751A

United States Patent [19]

Rittner

[11] Patent Number: 5,984,751

[45] Date of Patent: Nov. 16, 1999

[54] METHOD FOR MANUFACTURING AN ELECTRIC LIGHT BULB

[75] Inventor: Roland Rittner, Herbrechtingen, Germany

[73] Assignee: Patent-Treuhand-Gesellschaft fuer elektrische Gluehlampen mbH, Munich, Germany

[21] Appl. No.: 09/171,352

[22] PCT Filed: Feb. 10, 1998

[86] PCT No.: PCT/DE98/00367

§ 371 Date: Oct. 16, 1998

§ 102(e) Date: Oct. 16, 1998

[87] PCT Pub. No.: WO98/38670

PCT Pub. Date: Sep. 3, 1998

[30] Foreign Application Priority Data

Feb. 25, 1997 [DE] Germany ..... 197 07 245

[51] Int. Cl.[6] ..... H01J 9/24

[52] U.S. Cl. ..... 445/27; 313/117

[58] Field of Search ..... 445/27, 32; 313/117

[56] References Cited

U.S. PATENT DOCUMENTS 2,224,855 12/1940 Braunsdorff .
3,824,421 7/1974 Schuringa et al. .
3,962,596 6/1976 Draper .
4,893,050 1/1990 Fields ..... 445/27

FOREIGN PATENT DOCUMENTS 2348570 11/1977 France .
2243717 3/1973 Germany .
224445 7/1985 Germany .
1313532 4/1970 United Kingdom .

*Primary Examiner*—Kenneth J. Ramsey
*Attorney, Agent, or Firm*—William E. Meyer

[57] ABSTRACT

The invention relates to a method for producing an electric incandescent lamp which has at least one incandescent filament (31) and an anti-dazzle device (20). According to the invention, in the course of the method, an end (31*a*) of an incandescent filament (31) is threaded into a notch (23) on the edge of the anti-dazzle device (20) and fused with the anti-dazzle device (20) by melting the material of the anti-dazzle device (20) in the region of the notch (23) so that the melt wets the incandescent filament end (31*a*) arranged in the notch (23) and the incandescent filament end (31*a*) is embedded in the solidified material (20*a*) of the anti-dazzle device (20) after the melt has solidified.

6 Claims, 3 Drawing Sheets

METHOD FOR MANUFACTURING AN ELECTRIC LIGHT BULB

Figure 1:
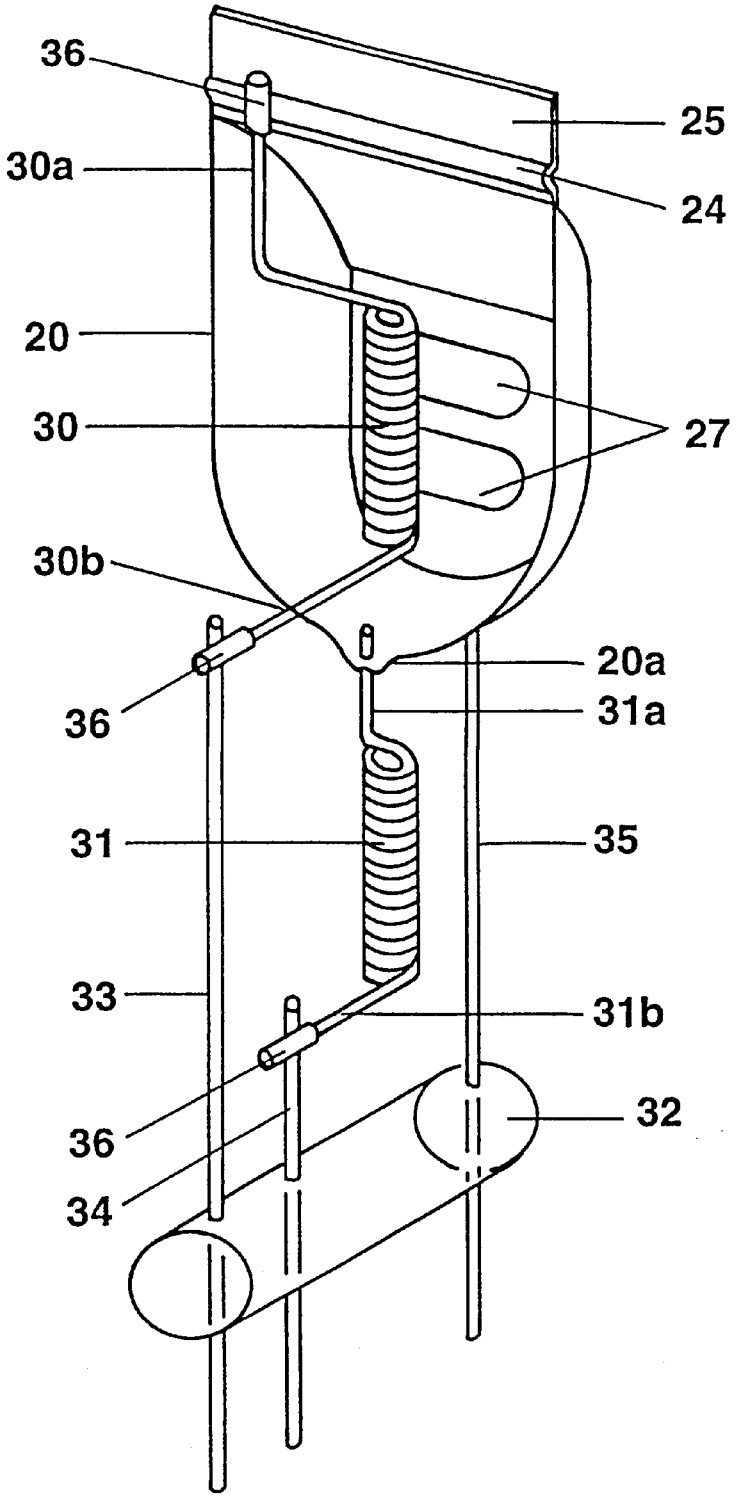

The invention relates to a method for producing an electric incandescent lamp in accordance with the preamble of Patent claim 1.

Prior Art

Such a method of production is disclosed, for example, in German Patent DE 22 43 717. This patent describes a two-filament halogen incandescent lamp having an anti-dazzle device and an incandescent filament arranged in the anti-dazzle device. The anti-dazzle device has a welding lug provided with a transverse rib. The incandescent filament ends are wrapped in each case in a metal foil. Here, the incandescent filament is fixed on the anti-dazzle device by fastening one of the filament ends enclosed in the metal foil to the transverse rib by a spot weld.

Description of the Invention

It is the object of the invention to provide a method for producing an electric incandescent lamp equipped with an anti-dazzle device and at least one incandescent filament, which method permits simpler fastening of the incandescent filament end to the anti-dazzle device.

This object is achieved according to the invention by the characterizing features of Patent claim 1. Particularly advantageous embodiments of the invention are described in the subclaims.

The method of production according to the invention for an electric incandescent lamp provided with at least one incandescent filament and an anti-dazzle device is distinguished in that said method has the following production steps:

- Provision of an anti-dazzle device whose edge is provided with a notch,
- Provision of an incandescent filament,
- Threading an incandescent filament end into the notch, and
- Melting the anti-dazzle device with the incandescent filament end arranged in the notch by melting the material of the anti-dazzle device in the region of the notch so that the melt wets the incandescent filament end arranged in the notch, and the incandescent filament end is embedded after the melt solidifies in the resolidified material of the anti-dazzle device.

By comparison with the prior art, the method of production according to the invention renders possible a simpler fastening of an incandescent filament end to the anti-dazzle device, because now at least one of the metal foils enclosing the filament ends can be saved. Fusing the incandescent filament end in a notch on the edge of the anti-dazzle device in the way according to the invention can be carried out both for uncoiled and for coiled incandescent filament ends. In order to fuse the anti-dazzle device with the incandescent filament end threaded in the notch at the edge of the anti-dazzle device, the material of the anti-dazzle device is advantageously melted on both sides of the notch. It is thereby ensured that the incandescent filament end is embedded completely in the resolidified melt of the anti-dazzle device. The anti-dazzle device is advantageously formed from a metal sheet so that it can serve as an electric supply lead for the incandescent filament connected to the anti-dazzle device. The notch at the edge of the anti-dazzle device is advantageously formed from two neighbouring projections projecting from the anti-dazzle device, which have a V-shaped or U-shaped interspace. These two exposed projections can be heated and melted with a comparatively low expenditure of energy with the aid of a laser. The method of production according to the invention is particularly suitable for producing two-filament halogen incandescent lamps which are used as a light source in motor vehicle headlamps.

DESCRIPTION OF THE PREFERRED EXEMPLARY EMBODIMENT

Figure 2:
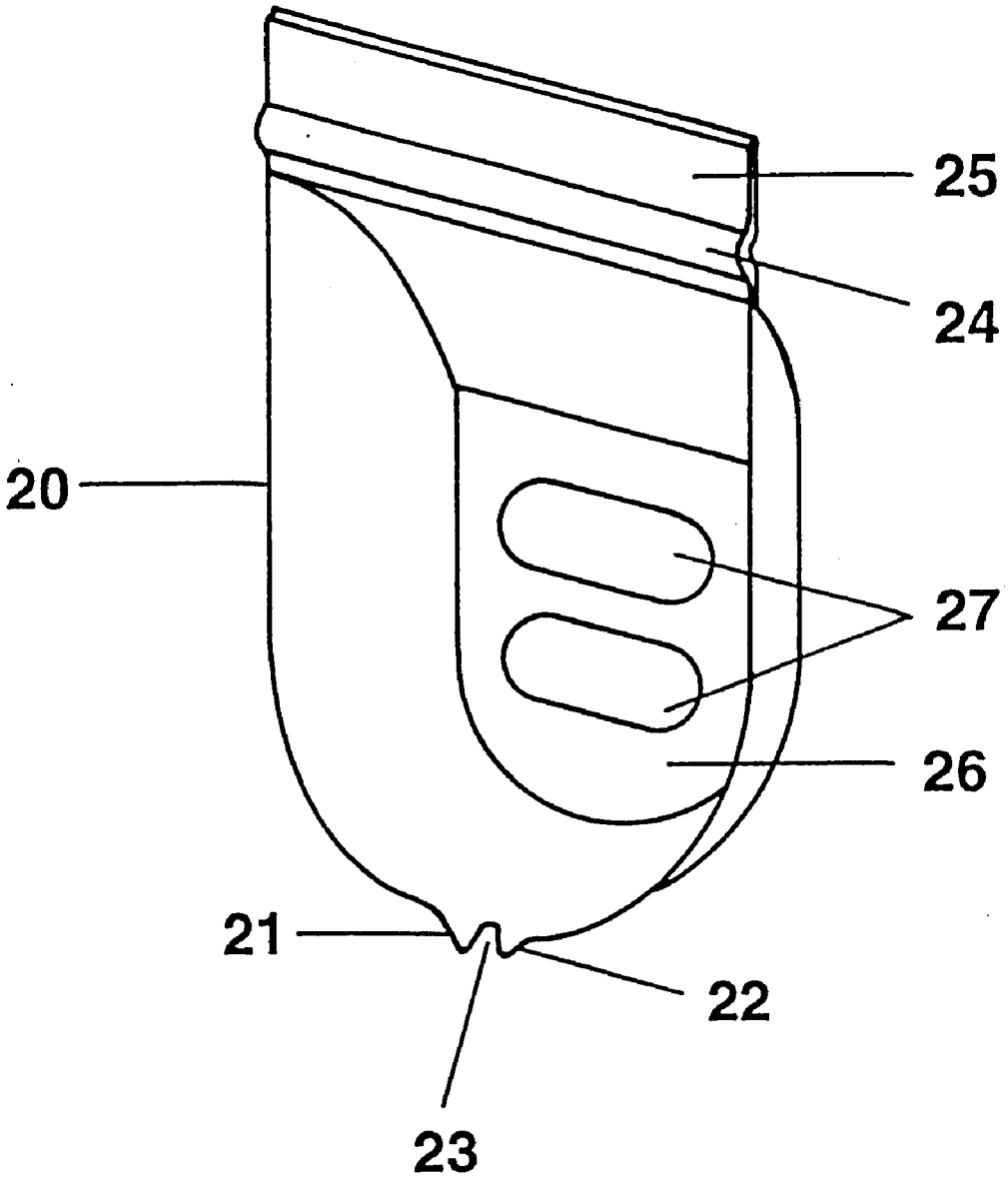
Figure 3:
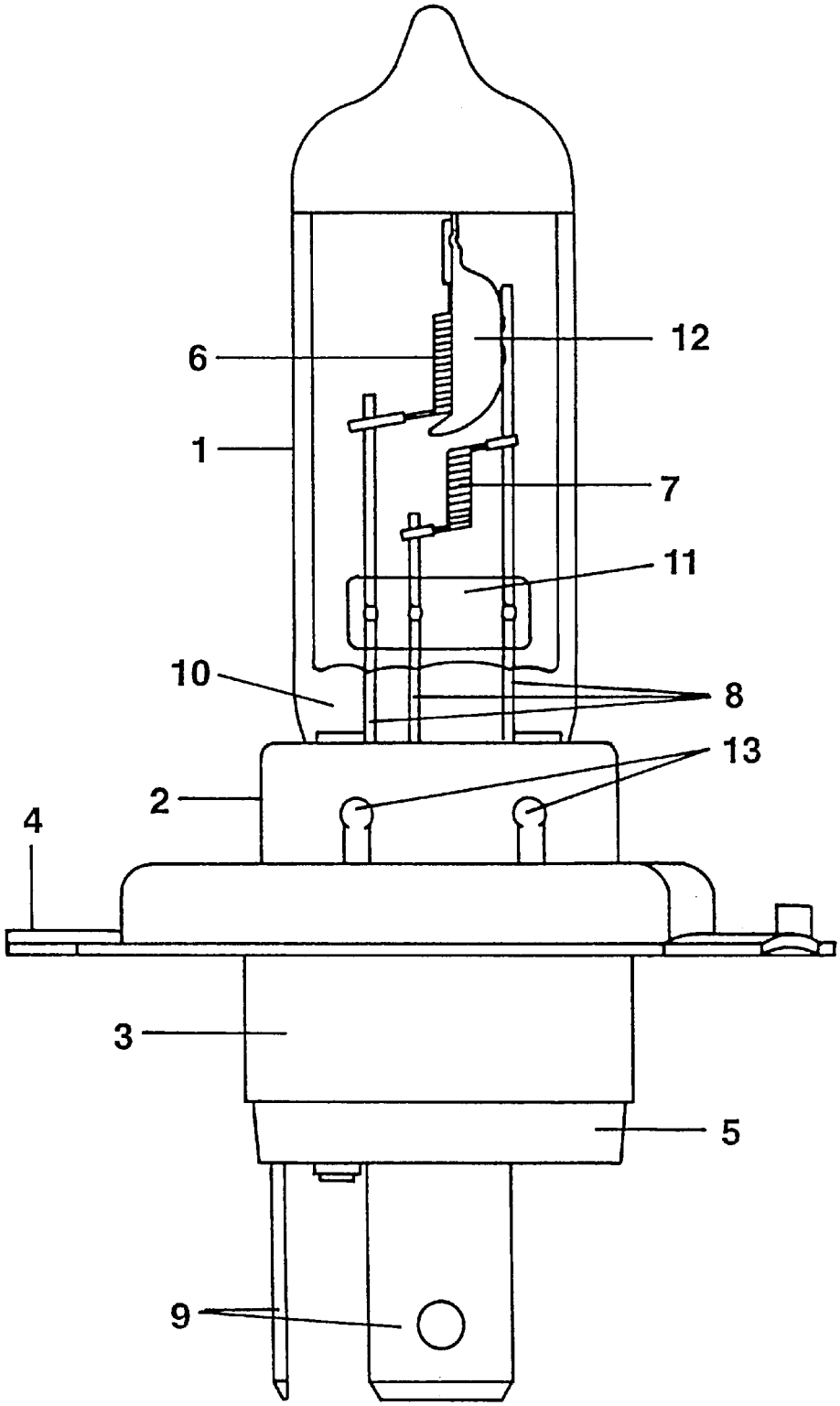

The invention is explained in more detail below with the aid of a preferred exemplary embodiment. In the drawing:

FIG. 1 shows an incandescent filament frame, produced in accordance with the method according to the invention, for a two-filament halogen incandescent lamp having two incandescent filaments, an anti-dazzle device and the supply leads associated therewith, FIG. 2 shows an anti-dazzle device provided for the method of production according to the invention, and FIG. 3 shows a two-filament halogen incandescent lamp in accordance with the prior art.

The method of production according to the invention is to be explained below with the aid of a two-filament halogen incandescent lamp, a so-called H4 lamp. The design of the H4 lamp is represented diagrammatically in FIG. 3. The two-filament halogen incandescent lamp depicted in FIG. 3 has a lamp bulb 1 which is made from hard glass and is pinched in a sealed fashion at one end. The pinch seal 10 of the lamp bulb 1 is fixed in a clamped fashion in a pot-shaped holder part 2 made from stainless steel. The holder part 2 forms the lamp cap together with the cap shell 3 and the adjusting plate 4 integrally formed thereon as well as with the cap insulator 5. The holder part 2 is welded to the adjusting plate 4 via welding lugs 13 punched out of the adjusting plate 4 and bent upwards. Located inside the lamp bulb 1 are two incandescent filaments 6, 7 which are respectively connected in an electrically conducting fashion to a contact lug 9 via a total of three supply leads 8 projecting from the pinch seal 10 and sealed between two quartz beams 11. One of the incandescent filaments 6 is provided with an anti-dazzle device 12.

In order to produce the incandescent filament holder of an H4 lamp in accordance with the method of production according to the invention, a prefabricated trough-like anti-dazzle device 20 is prepared from a metal sheet, preferably a molybdenum sheet (FIG. 2). At its edge, this anti-dazzle device 20 has two neighbouring projections 21, 22, which project like teeth and form with one another an interspace constructed as a V-shape or U-shaped notch 23. The anti-dazzle device 20 further has a welding lug 25 provided with a transverse rib 24. The base of the anti-dazzle device 20 is fitted with two projections 27. Furthermore, two prefabricated incandescent filaments 30, 31 and three supply lead wires 33, 34, 35 made from molybdenum are provided for the method of production according to the invention. In order to fix the anti-dazzle device 20, the supply lead wire 35 is welded on the outside of the anti-dazzle device 20 to the two projections 27 arranged in the base 26 of the anti-dazzle device 20.

The ends 30*a*, 30*b* of the dipped beam filament 30 are in each case wrapped in a molybdenum foil 36 and spot welded to the transverse rib 24 on the welding lug 25 of the anti-dazzle device 20 or to an end of the supply lead wire 33, with the result that the incandescent filament 30 is arranged in the anti-dazzle device 20. In order to fix the main beam filament 31 arranged below the anti-dazzle device 20, an end 31*a* of the main beam filament 31 is inserted into the notch 23 formed by the tooth-like projections 21, 22, and the two projections 21, 22 are subsequently heated and melted simultaneously with the aid in each case of a LASER beam acting for a short time on the two projections 21, 22, with the result that the filament end 31*a* is wetted by the melt and completely enclosed. After the solidification of the melt, the end 31*a* of the main beam filament 31 is completely embedded in the solidified material 20*a* of the anti-dazzle device 20. The resolidified material 20*a* then forms the shading nose 20*a* of the anti-dazzle device 20. The other end 31*b* of the main beam filament 31 is wrapped in a molybdenum foil 36 and spot welded to the supply lead wire 34. The incandescent filament frame produced in this way is depicted with the anti-dazzle device in FIG. 1. This complete filament frame is inserted in a known way into the prefabricated lamp bulb 1 and mounted. Sealing the lamp bulb 1 by means of the pinch seal 10, and capping the lamp are likewise prior art and are therefore not to be described in more detail here.

The invention is not restricted to the exemplary embodiment explained in detail. For example, the filament end 30*a* of the dipped beam filament 30 which is welded to the transverse rib 24 can also be fused in the same way as the end 31*a* of the main beam filament 31 with the edge of the anti-dazzle device 20. Moreover, the application of the fusing according to the invention of incandescent filament end and anti-dazzle device is not restricted to two-filament halogen incandescent lamps.

I claim:

1. Method for producing an electric incandescent lamp, which has a lamp vessel (1), at least one incandescent filament (31) and an anti-dazzle device (20), characterized in that the method contains the following steps:

Provision of an anti-dazzle device (20) whose edge is provided with a notch (23), Provision of an incandescent filament (31), Threading an incandescent filament end (31*a*) into the notch (23), and Melting the anti-dazzle device (20) with the incandescent filament end (31*a*) arranged in the notch (23) by melting the material of the anti-dazzle device (20) in the region of the notch (23) so that the melt wets the incandescent filament end (31*a*) arranged in the notch (23), and the incandescent filament end (31*a*) is embedded after the melt solidifies in the solidified material (20*a*) of the anti-dazzle device (20).

2. Method according to claim 1, characterized in that the material of the anti-dazzle device (20) is melted on both sides of the notch (23).

3. Method according to claim 1, characterized in that the anti-dazzle device (20) is produced from a metal sheet.

4. Method according to claim 1, characterized in that the notch (23) on the edge of the anti-dazzle device (20) is a V-shaped or U-shaped interspace which is formed by two neighbouring projections (21, 22) projecting from the anti-dazzle device (20).

5. Method according to claim 4, characterized in that to fasten the incandescent filament end (31*a*) arranged in the notch (23), the two projections (31, 32) are heated and melted.

6. Electric incandescent lamp having two incandescent filaments (30, 31) and an anti-dazzle device (20) for one of these incandescent filaments (30) produced in accordance with the method according to claim 1.

* * * * *